US006382387B1

(12) United States Patent
Morad et al.

(10) Patent No.: US 6,382,387 B1
(45) Date of Patent: May 7, 2002

(54) VENDING MACHINE HAVING A MECHANISM FOR PREVENTING A KNOB FROM TURNING AND ACCEPTING MONEY WHEN THE MACHINE IS OUT OF PRODUCT

(75) Inventors: Fred I. Morad, Toluca Lake; James G. Horian, Newport Beach, both of CA (US)

(73) Assignee: Worldwide Integrated Resources, Inc., Commerce, CA (US)

( * ) Notice: Subject to any disclaimer, the term of this patent is extended or adjusted under 35 U.S.C. 154(b) by 0 days.

(21) Appl. No.: 09/464,904

(22) Filed: Dec. 16, 1999

(51) Int. Cl.[7] ..... G07F 11/00
(52) U.S. Cl. ..... 194/351; 194/350
(58) Field of Search ..... 194/350, 351; 221/6, 17, 274

(56) References Cited

U.S. PATENT DOCUMENTS

| | | | | | |
|---|---|---|---|---|---|
| 3,237,744 | A | * | 3/1966 | Hill | 194/351 X |
| 5,007,519 | A | * | 4/1991 | Mercurio | 194/351 X |
| 5,167,345 | A | | 12/1992 | Bleeker | |
| 5,351,840 | A | | 10/1994 | Visco et al. | |
| D371,707 | S | | 7/1996 | Miles | |
| 5,555,965 | A | | 9/1996 | Mishina | |
| 5,752,622 | A | | 5/1998 | Abell | |
| 6,076,650 | A | * | 6/2000 | ScHwaRzli | 194/351 X |

* cited by examiner

*Primary Examiner*—James R. Bidwell
(74) *Attorney, Agent, or Firm*—Thomas I. Rozsa; Tony D. Chen

(57) ABSTRACT

A manual currency operated vending machine includes a mechanism for preventing customers from depositing a currency into the vending machine when the machine is out of product. The vending machine comprises two parallel vertical magazines for containing flat packages and tubular packages. A currency operated dispensing mechanism includes a currency operating knob connected to a blocking mechanism through a rotatable shaft. The blocking mechanism is positioned at the bottom of each magazine for supporting the articles and preventing them sliding out, and also for allowing the lowest article out of the magazine and into a trough at the vending opening slot. When the currency operating knob is turned, it allows a currency to be deposited into the vending machine. The knob turns the rotatably shaft which in turn moves the blocking mechanism into an unobstructed position allowing the lowest article out of the magazine and into the trough at the vending opening slot. At the same time, the magazine supports the remaining articles thereto. When the knob is further turned, it moves back to its initial position, thereby blocking the next product from being dispensed. The currency operated dispensing mechanism also has a spring-biased blocking member located at the top of the mechanism and when depressed blocks a passageway and prevents a currency from being deposited into the vending machine.

19 Claims, 5 Drawing Sheets

VENDING MACHINE HAVING A MECHANISM FOR PREVENTING A KNOB FROM TURNING AND ACCEPTING MONEY WHEN THE MACHINE IS OUT OF PRODUCT

BACKGROUND OF THE INVENTION

1. Field of the Invention

The present invention generally relates to the field of devices for dispensing products, typically operated by a customer depositing a coin and turning a lever or shaft or pushing a button. More particularly, the present invention relates to the field of vending machines having means for preventing a customer from depositing a coin when all product has been sold and the machine is empty and has no more product to dispense.

2. Description of the Prior Art

Specifically, manual vending machines are well known in the art. These manual vending machines are coin operated and gravity fed. One of the disadvantages with these manual vending machines is that they do not have a mechanism for preventing the coin operated knob from accepting the coin when the machine is empty and has no more product to dispense. Further, when customers deposit a coin into the coin operated knob and turn the knob expecting to receive the product from the vending machine and do not receive it, they usually get angry and sometimes break the vending machine to try to get the product or receive their money back. It is very costly to the owners of vending machines to replace the broken vending machine.

The following five (5) prior art patents are found to be pertinent to the field of the present invention:

1. U.S. Pat. No. 5,167,345 issued to Bleeker on Dec. 1, 1992 for "Dual Dispenser" (hereafter the "Bleeker Patent");
2. U.S. Pat. No. 5,351,840 issued to Visco et al. on Oct. 4, 1995 for "Combined Chalk And Eraser Dispenser" (hereafter the "Visco Patent");
3. U.S. Pat. No. 5,555,965 issued to Mishina on Sep. 17, 1996 for "Battery Operated Vending Machine For Dispensing Cylindrical And Tetrahedron-Shaped Objects" (hereafter the "Mishina Patent");
4. U.S. Pat. No. 5,752,622 issued to Abell on May 19, 1998 for "Feminine Protection Dispenser" (hereafter the "Abell Patent"); and
5. U.S. Design Pat. No. 371,707 issued to Miles on Jul. 16, 1996 for "Dispenser For Sanitary Products" (hereafter the "Miles Patent").

The Bleeker Patent discloses a dual dispenser for dispensing a first type of article from first and second stacks of the first articles and a second type of article from a stack of the second articles. The dispenser includes a housing with first and second magazines for holding the stacks of the first articles and a third magazine for holding the stack of the second articles, with a single article discharge slot in the housing and with means within the housing for movement of articles from each of the stacks to the discharge slot. The Bleeker device is a very complicated device. Essentially, this is a dispenser which dispenses flat type articles through a single slot opening.

The Visco Patent discloses a combined chalk and eraser dispenser. It comprises an eraser retaining means which has a dispensing opening defined in a lower forward portion and a chalk receptacle for chalk pieces of a selected chalk length attached to the eraser retaining means. The chalk receptacle has a rear vertical wall and a forward opening. Essentially, this is a dispenser for dispensing rectangular chalkboard erasers and chalks.

The Mishina Patent discloses a battery operated vending machine for dispensing cylindrical and tetrahedron-shaped objects. It comprises a rotary dispensing mechanism for dispensing cylindrical objects including a product stack of cylindrical objects which feeds into the rotary dispensing assembly which feeds the cylindrical objects into a dispensing area for access by the consumer. The vending machine also comprises a plunger dispenser assembly for dispensing tetrahedron-shaped objects into the dispensing area. The vending machine further comprises a sensor for sensing product depletion of product stacks above each dispenser, actuators for displaying "sold-out" signs for each dispenser when there is no more product in the dispenser and a mechanism for blocking a coin slot when there is no more product in the dispenser.

The Abell Patent discloses a feminine protection dispenser. It comprises a single light weight vertically disposed housing used to store and allow dispersal of at least two different personal feminine hygiene articles. At the housing's upper section, there is a toilet paper dispenser and at its lower section, a loading area for tampons or sanitary napkins.

The Miles Patent discloses a dispenser for sanitary products. The Miles Patent is not a coin operated dispenser.

It is desirable to provide a manual coin operated vending machine which includes a mechanism for preventing customers from depositing a coin into the vending machine when the machine is out of product.

SUMMARY OF THE INVENTION

The present invention is a manual vending machine or dispenser which includes a mechanism for preventing customers from depositing currency into the vending machine when the machine has no more product to be purchased. The vending machine dispenses sanitary napkins which are in a flat package and tampons which are in a tubular package.

The vending machine comprises two parallel side by side vertical magazines for containing flat packages and tubular packages. A currency operated dispensing mechanism includes a currency operated knob connected to a blocking mechanism through a rotatable shaft. The blocking mechanism is positioned at the bottom of each magazine for supporting the products and preventing them from sliding out, and also for allowing the lowest product to be dispensed out of the magazine and into a trough at the vending opening slot. When the currency operated knob is turned, it allows a currency to be deposited into a currency receiving compartment in the vending machine. The knob turns the rotatable shaft which in turn moves the blocking mechanism into an unobstructed position allowing the lowest product out of the magazine and into the trough at the vending opening slot. At the same time, the magazine supports the remaining products therein. When the knob is further turned, it turns back to its initial position, where the blocking mechanism moves back to its initial position (the blocking position).

The currency operated dispensing mechanism also has a spring-biased blocking means located at the top of the currency operated dispensing mechanism and when depressed blocks a passageway and prevents a currency from being accepted by the vending machine.

A weight supporting device is placed on top of the products in each magazine and serves as a weight for retaining the products in the magazine and also serves as an actuating means which depresses the spring-biased blocking means and blocks the passageway to prevent a customer from depositing currency into the vending machine when the machine is out of product. The weight supporting device only comes in contact with and actuates the spring biased blocking means when there is no more product between the weight support device and the spring biased blocking means.

It is therefore an object of the present invention to provide a reliable, easily operated vending machine which requires little maintenance other than periodic refilling with product packages.

It is a further object of the present invention to provide a vending machine which includes a mechanism for preventing customers from depositing a currency into the vending machine when the machine is out of product.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
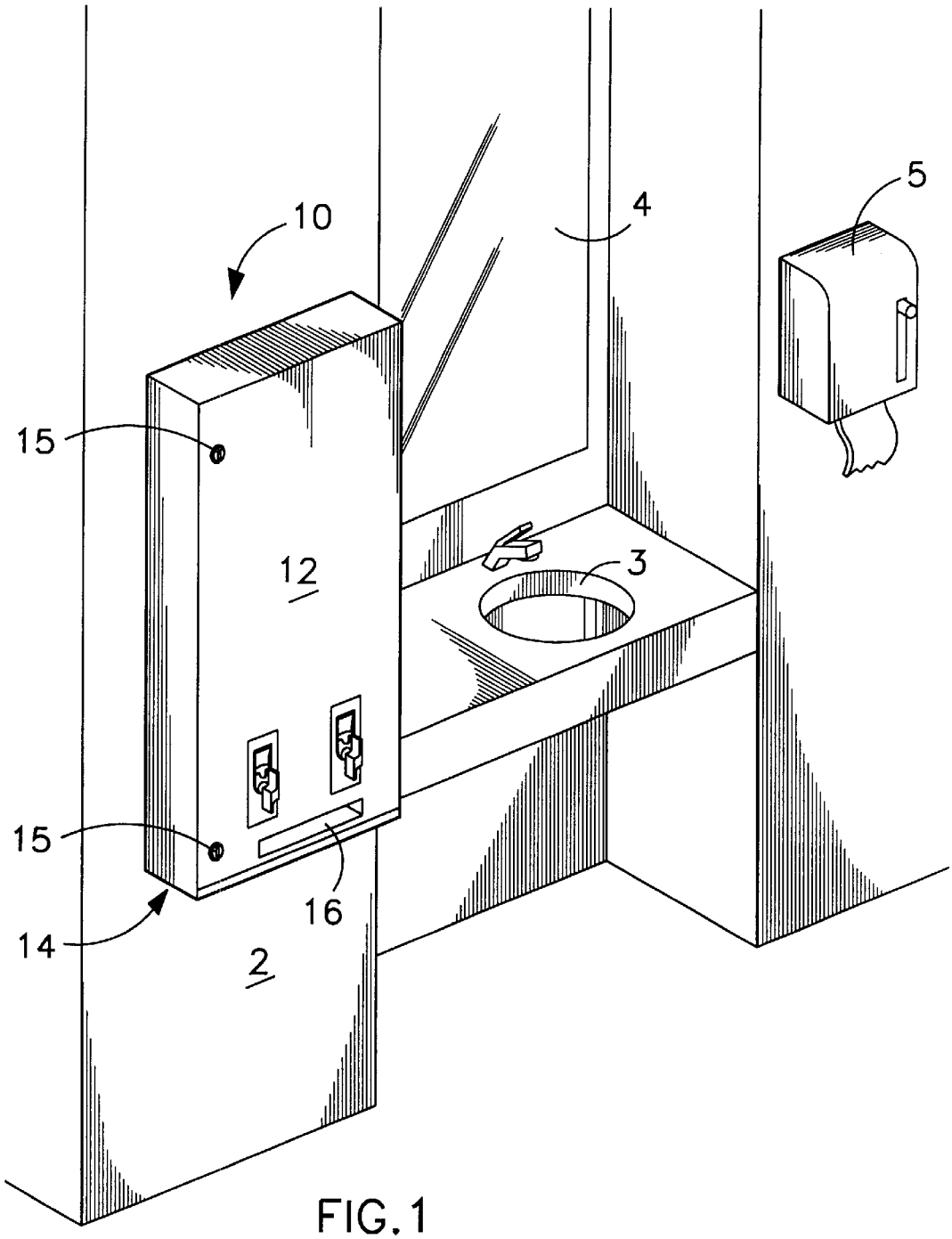
FIG. 1 is an illustration of a wall of a washroom with the present invention vending machine mounted to the wall, showing the front of the vending machine.

Referring to FIG. 1, there is illustrated at 10 the present invention manual vending machine mounted to a wall 2 of a washroom or the like, which also includes a basin 3, a mirror 4 and a towel holder 5. The vending machine 10 may dispense flat packages and tubular packages, preferably sanitary napkins which are in a flat package and tampons which are in a tubular package. The vending machine 10 has a front panel 12 which is hingeably connected to a dispenser housing 14 for closing the front of the housing 14. A pair of locks 15 are provided for locking and unlocking the front panel 12 to the housing 14 to access the interior of the vending machine 10. The front panel 12 has a product discharge opening 16 incorporated in the vending machine 10.

Figure 2:
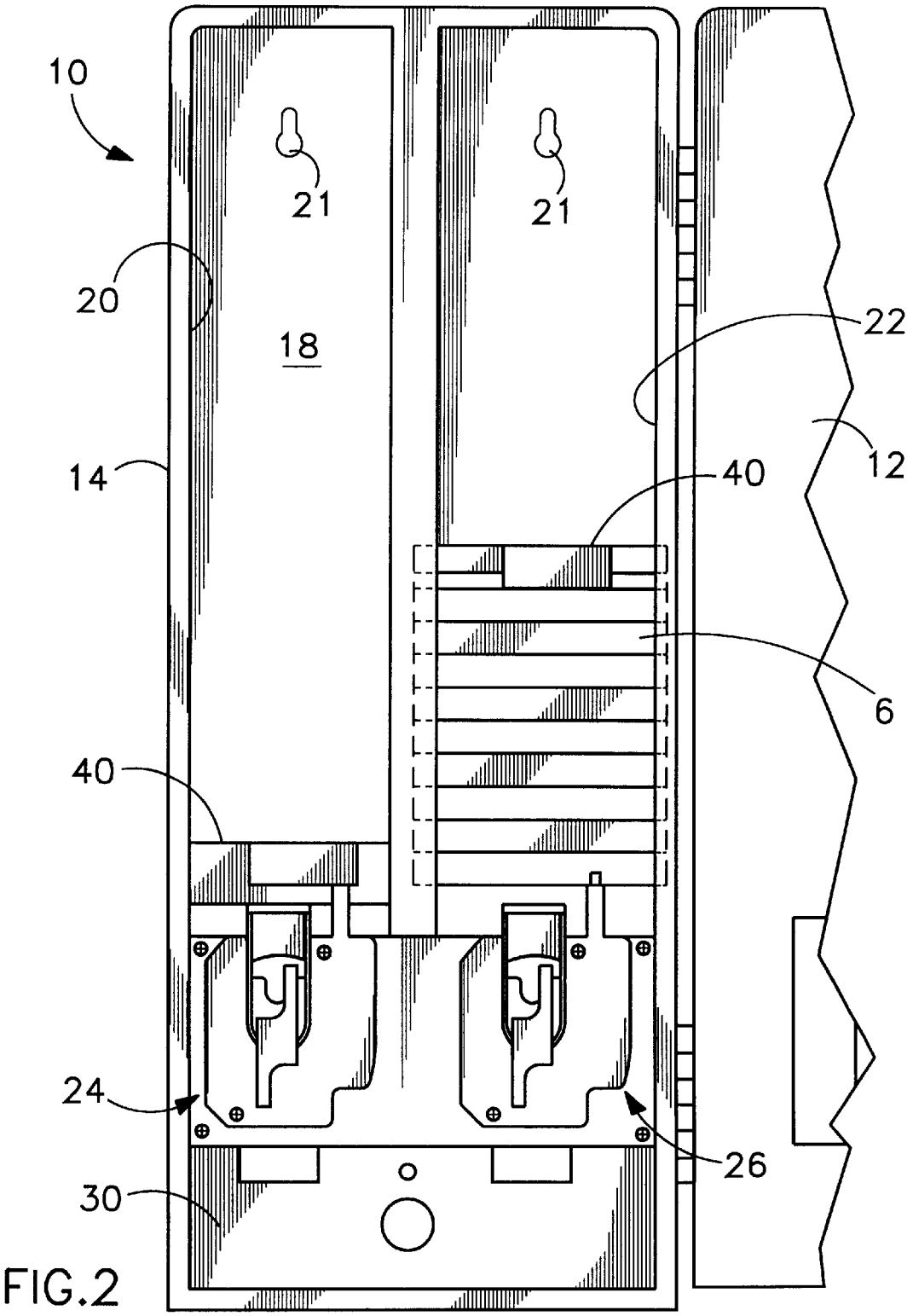
FIG. 2 is a front plan view of the present invention vending machine, with the front panel opened, showing the interior of the vending machine with one of the magazines empty and a weight supporting device engaged with a spring-biased blocking means, and the other one of the magazines in the partly loaded condition and another weight supporting device not engaged with a spring-biased blocking means.
Figure 3:
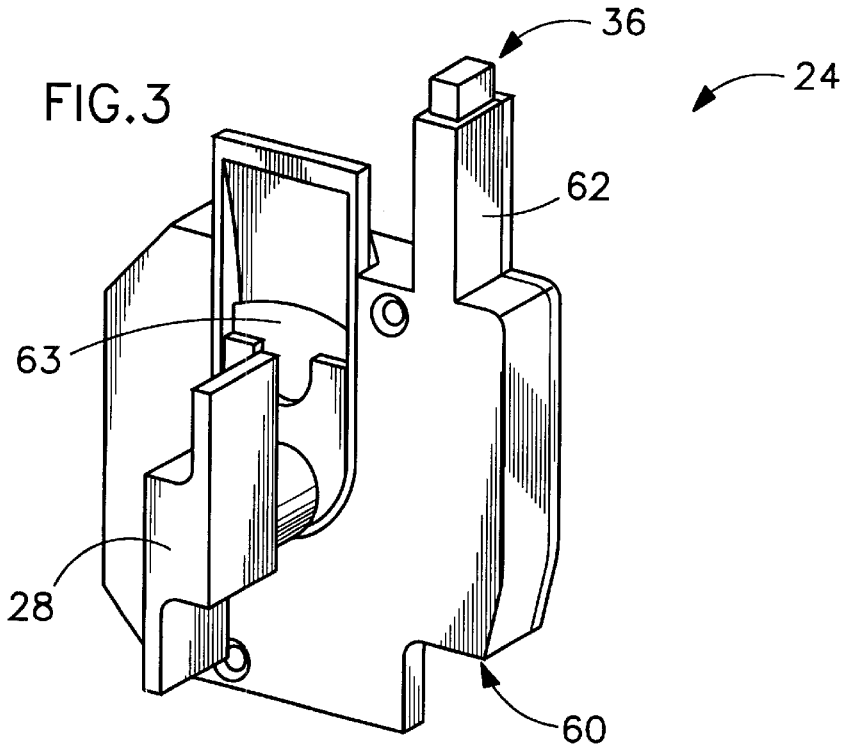
FIG. 3 is a front perspective view of a currency operated dispensing mechanism of the present invention vending machine, showing the spring-biased blocking means in its deactivated position.
Figure 4:
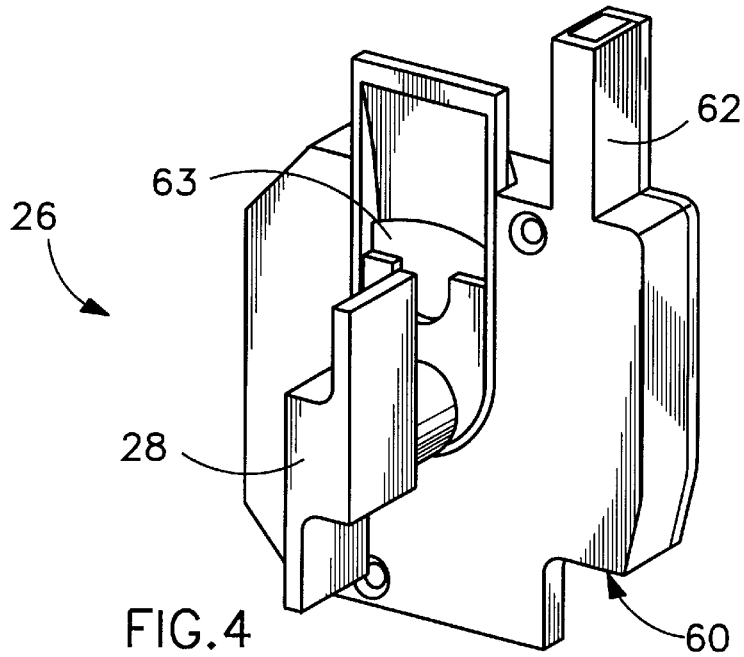
FIG. 4 is a front perspective view of the currency operated dispensing mechanism shown in FIG. 3, showing the spring-biased blocking means in its activated position.
Figure 5:
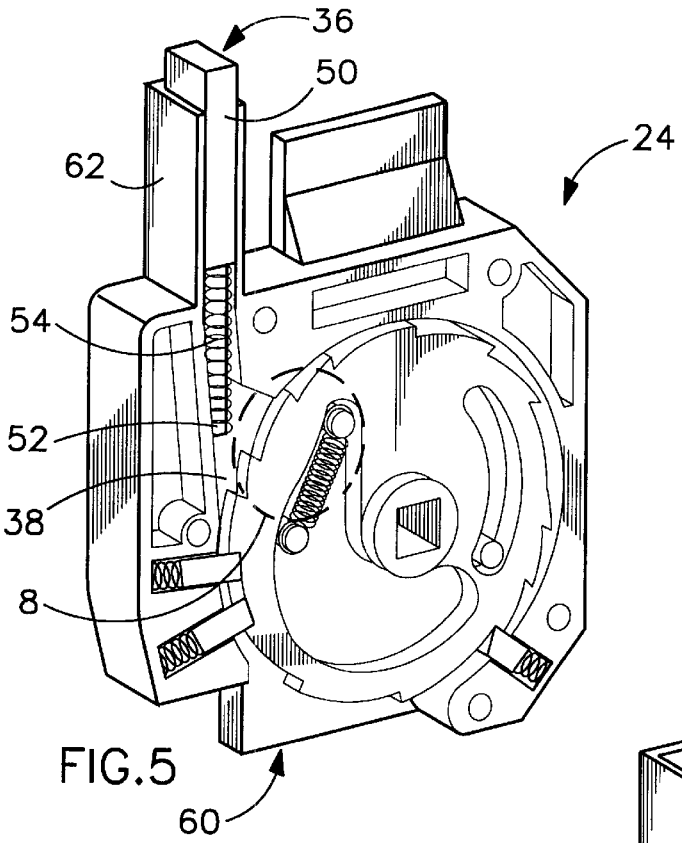
FIG. 5 is a rear perspective view of the currency operated dispensing mechanism of the present invention vending machine, showing the spring-biased blocking means in its deactivated position.
Figure 6:
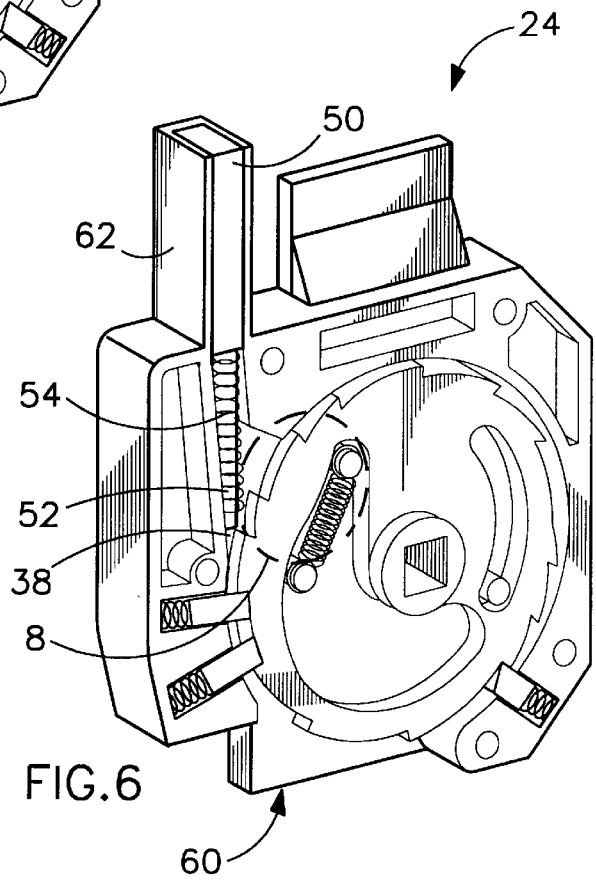
FIG. 6 is a rear perspective view of the currency operated dispensing mechanism shown in FIG. 5, showing the spring-biased blocking means in its activated position.
Figure 7:
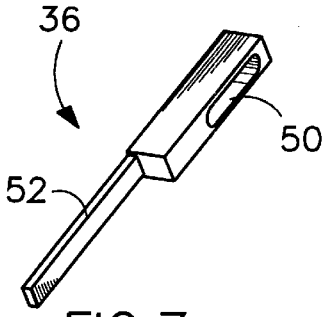
FIG. 7 is a perspective view of the spring-biased blocking means.
Figure 8:
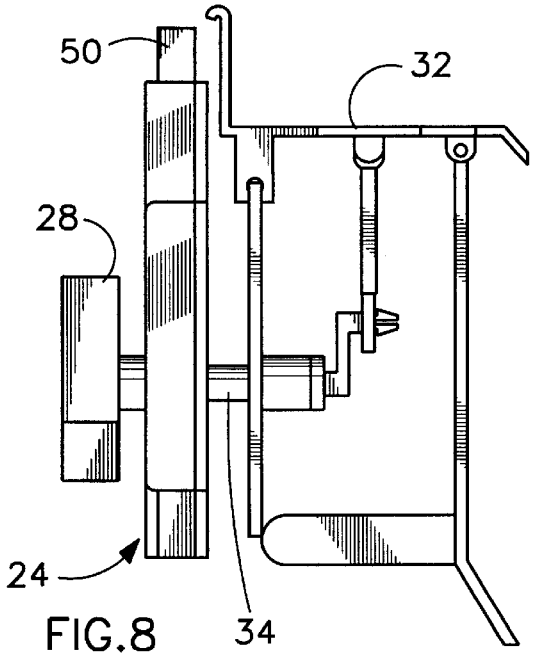
FIG. 8 is a side elevational view of the currency operated dispensing mechanism used in conjunction with a blocking mechanism of the present invention vending machine, showing the blocking mechanism in its blocking and supporting position.
Figure 9:
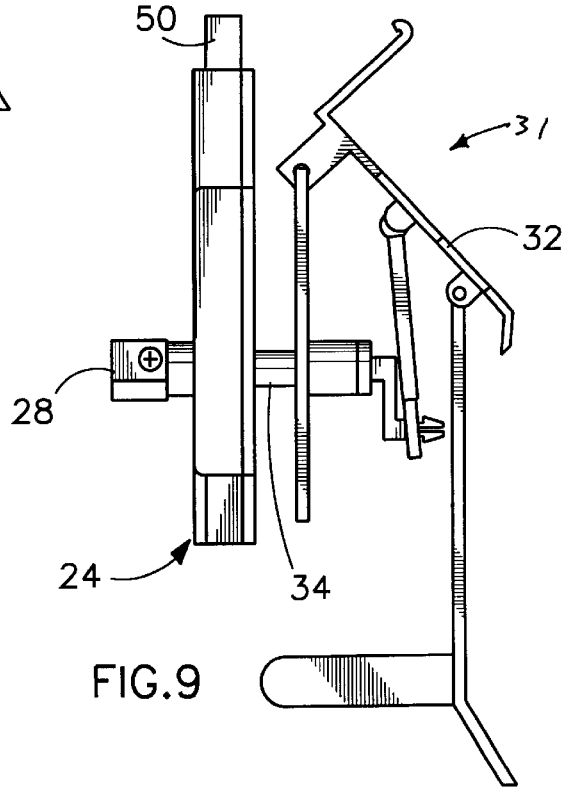
FIG. 9 is a side elevational view of the currency operated dispensing mechanism used in conjunction with the blocking mechanism of the present invention vending machine, showing the blocking mechanism in its released and unsupported position.

Referring to FIG. 2, there is shown at 10 the present invention vending machine with the front panel 12 opened showing the interior 18 of the housing 14. The vending machine 10 comprises two parallel side by side vertical gravity feed magazines 20 and 22 for respectively containing stacks of flat packages and tubular packages. The magazines 20 and 22 are manufactured in the conventional manner of sheet metal pieces welded or otherwise fastened together. Stacks of packages 6 to be dispensed are loaded into each of the magazines 20 and 22. As illustrated, only the magazine 22 is partly loaded with the packages 6. There are provided two mounting apertures 21 for mounting the vending machine to the wall 2.

There are shown two side by side currency operated dispensing mechanisms 24 and 26 which are respectively located at the bottom of the magazines 20 and 22. These currency operated dispensing mechanisms 24 and 26 are conventional in the art except for the improvement of a mechanism for preventing customers from depositing a currency into the vending machine 10 when the magazine is out of product.

Since the left currency operated dispensing mechanism 24 is substantially identical to the right currency operated dispensing mechanism 26, and to the extent they are, only the left currency operated dispensing mechanism 24 will be described in detail, unless otherwise explicitly indicated.

Referring to FIGS. 3, 4, 5, 6, 8 and 9, the currency operated dispensing mechanism 24 has a housing 60 which includes a top hollow protruding structure 62, a currency or currency slot 63 for receiving a currency 8 and a currency operated knob 28 for rotating the currency 8 into a passageway 38 and into a currency receiving compartment 30 (see FIG. 2). Upon receiving the currency 8, a product 6 is dispensed from the vending machine 10. The currency operated knob 28 is connected to a blocking mechanism 31 through a rotatable shaft 34. The blocking mechanism 31 is positioned at the bottom of each magazine for preventing products from sliding out, and also for allowing the lowest product to be dispensed out of the magazine and into the product discharge opening 16 (see FIG. 1). The blocking mechanism 31 is conventional in the art and will only be described in general terms. The blocking mechanism 31 has a blocking plate 32 which prevents the products from sliding out. When the currency operated knob 28 is turned, it allows the currency 8 to be accepted into the currency receiving compartment 30 of the vending machine 10. The knob 28 turns the rotatable shaft 34 which in turn moves the blocking plate 32 into an unobstructed position (see FIG. 9) allowing the lowest product to be dispensed out of the magazine and into the trough at the discharge opening 16 of the vending machine 10. At the same time, the magazine supports the remaining products therein. When the knob 28 is further turned clockwise back to its initial position, the blocking plate 32 moves back to its initial position (the blocking position, see FIG. 8) and thereby supports the next product to be dispensed and prevents it from being dispensed until the next coin is inserted and the knob turned.

Referring to FIGS. 3, 5, 6 and 7, there is provided a spring-biased blocking means 36 which is installed into the top hollow protruding structure 62 of the currency operated dispensing mechanism 24 and when depressed blocks the passageway 38 and prevents the currency 8 (shown as dashed lines in FIGS. 5 and 6) from being deposited into the currency receiving compartment 30 of the vending machine 10. The spring-biased blocking means 36 includes a depressable portion 50 partially extending out from the hollow protruding structure 62 of the currency operated dispensing mechanism 24 and a blocking portion 52 located within the housing 60 of the currency operated dispensing mechanism 24. The depressable portion 50 is biased upwardly by spring means 54 which is installed within the protruding structure 62.

Referring again to FIG. 2, there is provided a weight supporting device 40 which is positioned on top of the products 6 in each magazine and serves as a weight for retaining the products 6 in the magazine and also serves as an actuating means which depresses the depressable portion 50 of the spring-biased blocking means 36 and blocks the passageway 38 to prevent a customer from depositing the currency 8 into the vending machine 10 when a magazine is out of product. The weight 40 only comes in contact with the spring biased blocking means 36 when the magazine is out of product.

The present invention conforms to conventional forms of manufacture or any other conventional way known to one skilled in the art, and is of simple construction and is easy to use.

Defined in detail, the present invention is a vending machine for dispensing a product, comprising: (a) a housing having a first gravity feed magazine for containing a first stack of products resting on a first blocking plate and a second gravity feed magazine for containing a second stack of products resting on a second blocking plate; (b) a first weight supporting device positioned within the first magazine and on top of the first stack of products for retaining the first stack of products thereto; (c) a second weight supporting device positioned within the second magazine and on top of the second stack of products for retaining the second stack of products thereto; (d) a pair of currency operated mechanisms each respectively located at a bottom of the first and second magazines, each mechanism having a currency slot for accepting currency and a rotatable knob for rotating the currency into a passageway and into a currency receiving compartment and upon receiving the currency, a respective one of the first and second blocking plates is moved out of the way to dispense a product from a respective one of the first and second magazines; and (e) two spring biased blocking means with a respective one spring-biased blocking means respectively installed on top of the each currency operated mechanism and located adjacent to the passageway, each respectively spring-biased blocking means having a depressable portion partially extending out from the each currency operated mechanism and biased upwardly by a spring and a blocking portion located within the each currency operating mechanism, such that when a respective one of the first and second weight supporting devices depresses the depressable portion, the blocking portion is pushed into and blocks the passageway to prevent the currency from being accepted by the vending machine when the machine is out of product; (f) whereby when the depressable portion of the spring-biased blocking means is depressed, the blocking portion blocks the passageway into the currency receiving compartment of the vending machine when the machine is out of product.

Defined broadly, the present invention is a vending machine for dispensing a product, comprising: (a) a housing having at least one gravity feed magazine for containing a stack of products resting on a blocking plate; (b) a weight supporting device positioned within the at least one magazine and on top of the stack of products for retaining the stack of products thereto; (c) a currency operated mechanism located at a bottom of the at least one magazine and having a currency slot for accepting currency and a rotatable knob for rotating the currency into a passageway and into a currency receiving compartment and upon receiving the currency, the blocking plate is moved out of the way to dispense a product from the at least one gravity feed magazine; and (d) spring-biased blocking means installed on top of the currency operated mechanism and located adjacent to the passageway, the spring-biased blocking means having a depressable portion partially extending out from the currency operated mechanism and biased upwardly by spring means and a blocking portion located within the currency operated mechanism, such that when the weight supporting device depresses the depressable portion, the blocking portion is pushed into and blocks the passageway to prevent the currency from being accepted by the vending machine when there is no more product in the magazine; (e) whereby when the depressable portion of the spring-biased blocking means is depressed, the blocking portion blocks the passageway into the currency receiving compartment of the vending machine when the machine is out of product.

Defined more broadly, the present invention is a dispenser for dispensing a product, comprising: (a) a housing having at least one magazine for containing a stack of products resting on supporting means; (b) means for accepting currency and upon receiving the currency, the supporting means is moved out of the way to dispense a product from the at least one magazine; (c) means for blocking a passageway to prevent the currency from being accepted by the accepting currency means; and (d) means for activating the blocking means when the at least one magazine is out of product; (e) whereby when the blocking means is activated, the blocking means blocks the passageway to prevent the currency from being accepted by the dispenser when the dispensing is out of product.

Defined even more broadly, the present invention is a currency operated mechanism used in conjunction with a vending machine and having a housing for accommodating a currency slot for accepting currency and a rotatable knob for rotating the currency into a passageway and into a currency receiving compartment and upon receiving the currency, a product is dispensed from the vending machine, the currency operated mechanism comprising spring-biased blocking means installed on top of the housing and located adjacent to the passageway, the spring-biased locking means having a depressable portion partially extending out from the housing and biased upwardly by spring means and a blocking portion located within the housing, where upon depressing the depressable portion, the blocking portion is pushed into and blocks the passageway to prevent the currency from being accepted by the vending machine when the machine is out of product.

Defined even further more broadly, the present invention is a currency operated mechanism used in conjunction with a dispenser and having a housing for accommodating a currency slot for accepting currency and a knob for rotating the currency into a passageway and into the vending machine and upon receiving the currency, a product is dispensed therefrom, the currency operated mechanism comprising means for blocking the passageway to prevent the currency from being accepted by the vending machine when the machine is out of product.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A vending machine for dispensing a product, comprising:

a. a housing having a first gravity feed magazine for containing a first stack of products resting on a first blocking plate and a second gravity feed magazine for containing a second stack of products resting on a second blocking plate;

b. a first weight supporting device positioned within said first magazine and on top of said first stack of products for retaining said first stack of products thereto;

c. a second weight supporting device positioned within said second magazine and on top of said second stack of products for retaining said second stack of products thereto;

d. a pair of currency operated mechanisms each respectively located at a bottom of said first and second magazines, each mechanism having a currency slot for accepting currency and a rotatable knob for rotating the currency into a passageway and into a currency receiving compartment and upon receiving the currency, a respective one of said first and second blocking plates is moved out of the way to dispense a product from a respective one of said first and second magazines; and e. two spring biased blocking means with a respective one spring-biased blocking means respectively installed on top of said each currency operated mechanism and located adjacent to said passageway, each respective spring-biased blocking means having a depressable portion partially extending out from said each currency operated mechanism and biased upwardly by a spring and a blocking portion located within said each currency operating mechanism, such that when a respective one of said first and second weight supporting devices depresses the depressable portion, the blocking portion is pushed into and blocks said passageway to prevent said currency from being accepted by said vending machine when that respective magazine is out of product;

f. whereby when said depressable portion of said spring-biased blocking means is depressed, said blocking portion blocks said passageway into said currency receiving compartment of said vending machine when the magazine is out of product.

2. The vending machine in accordance with claim 1, further comprising mounting apertures for mounting said vending machine to a wall.

3. The vending machine in accordance with claim 1 wherein said first stack of products are sanitary napkins which are in a flat package and said second stack of products are tampons which are in a tubular package.

4. A vending machine for dispensing a product, comprising:

a. a housing having at least one gravity feed magazine for containing a stack of products resting on a blocking plate;

b. a weight supporting device positioned within said at least one magazine and on top of said stack of products for retaining said stack of products thereto;

c. a currency operated mechanism located at a bottom of said at least one magazine and having a currency slot for accepting currency and a rotatable knob for rotating the currency into a passageway and into a currency receiving compartment and upon receiving the currency, said blocking plate is moved out of the way to dispense a product from said at least one gravity feed magazine; and d. spring-biased blocking means installed on top of said currency operated mechanism and located adjacent to said passageway, the spring-biased blocking means having a depressable portion partially extending out from said currency operated mechanism and biased upwardly by spring means and a blocking portion located within said currency operated mechanism, such that when said weight supporting device depresses the depressable portion, the blocking portion is pushed into and blocks said passageway to prevent said currency from being accepted by said vending machine when there is no more product in the magazine;

e. whereby when said depressable portion of said spring-biased blocking means is depressed, said blocking portion blocks said passageway into said currency receiving compartment of said vending machine when the magazine is out of product.

5. The vending machine in accordance with claim 4, further comprising mounting apertures for mounting said vending machine to a wall.

6. The vending machine in accordance with claim 4 wherein said stack of products are sanitary napkins which are in a flat package.

7. The vending machine in accordance with claim 4 wherein said stack of products are tampons which are in a tubular package.

8. A dispenser for dispensing a product, comprising:

a. a housing having at least one magazine for containing a stack of products resting on supporting means;

b. means for accepting currency and upon receiving the currency, said supporting means is moved out of the way to dispense a product from said at least one magazine;

c. means for blocking a passageway to prevent the currency from being accepted by said accepting currency means, said blocking means including a spring-biased blocking structure having a depressable portion partially extending out from said accepting currency means and biased upwardly by spring means and a blocking portion, such that when said activating means depresses the depressable portion, the blocking portion is pushed into and blocks said passageway to prevent said currency from being accepted by said dispenser when the dispenser is out of product; and d. means for activating said blocking means when said at least one magazine is out of product;

e. whereby when said blocking means is activated, said blocking means blocks said passageway to prevent said currency from being accepted by said dispenser when said dispenser is out of product.

9. The dispenser in accordance with claim 8, further comprising mounting apertures for mounting said dispenser to a wall.

10. The dispenser in accordance with claim 8, wherein said accepting currency means includes a currency operated dispensing mechanism.

11. The dispenser in accordance with claim 8 wherein said stack of products are tampons which are in a tubular package.

12. The dispenser in accordance with claim 8, wherein said activating means is a weight supporting device positioned within said at least one magazine and on top of said stack of products for retaining said stack of products thereto, and only comes in contact with said activating means when the dispenser is out of product.

13. The dispenser in accordance with claim 8 wherein said stack of products are sanitary napkins which are in a flat package.

14. A dispenser for dispensing a product, comprising:

a. a housing having at least one magazine for containing a stack of products resting on supporting means;

b. means for accepting currency and upon receiving the currency, said supporting means is moved out of the way to dispense a product from said at least one magazine;

c. means for blocking a passageway to prevent the currency from being accepted by said accepting currency means; and d. means for activating said blocking means when said at least one magazine is out of product, said activating means including a weight supporting device positioned within said at least one magazine and on top of said stack of products for retaining said stack of products thereto, and only comes in contact with said activating means when the dispenser is out of product;

e. whereby when said blocking means is activated, said blocking means blocks said passageway to prevent said currency from being accepted by said dispenser when said dispenser is out of product.

15. The dispenser in accordance with claim 14, further comprising mounting apertures for mounting said dispenser to a wall.

16. The dispenser in accordance with claim 14, wherein said accepting currency means includes a currency operated dispensing mechanism.

17. The dispenser in accordance with claim 14, wherein said blocking means includes a spring-biased blocking structure having a depressable portion partially extending out from said accepting currency means and biased upwardly by spring means and a blocking portion, such that when said activating means depresses the depressable portion, the blocking portion is pushed into and blocks said passageway to prevent said currency from being accepted by said dispenser when the dispenser is out of product.

18. The dispenser in accordance with claim 14, wherein said stack of products are sanitary napkins which are in a flat package.

19. The dispenser in accordance with claim 14, wherein said stack of products are tampons which are in a tubular package.

* * * * *